US010621950B2

(12) United States Patent
Kumar et al.

(10) Patent No.: US 10,621,950 B2
(45) Date of Patent: Apr. 14, 2020

(54) SYSTEM AND METHOD FOR CORRECTING PHOTOSENSITIVE EPILEPSY LUMINANCE FLASHES IN A VIDEO

(71) Applicants: Alok Kumar, Kapurthala (IN); Bhupender Kumar, Palwal (IN); Shekhar Madnani, Noida (IN)

(72) Inventors: Alok Kumar, Kapurthala (IN); Bhupender Kumar, Palwal (IN); Shekhar Madnani, Noida (IN)

(73) Assignee: Interra Systems, Cupertino, CA (US)

( * ) Notice: Subject to any disclaimer, the term of this patent is extended or adjusted under 35 U.S.C. 154(b) by 0 days.

(21) Appl. No.: 15/908,835

(22) Filed: Mar. 1, 2018

(65) Prior Publication Data

US 2019/0385569 A1 Dec. 19, 2019

(51) Int. Cl.

| | |
|---|---|
| ***G09G 5/00*** | (2006.01) |
| ***G09G 5/10*** | (2006.01) |
| ***G09G 3/36*** | (2006.01) |

(52) U.S. Cl.

CPC ..... *G09G 5/10* (2013.01); *G09G 3/3648* (2013.01); *G09G 2320/0247* (2013.01)

(58) Field of Classification Search

CPC ..... G01J 1/32; G06F 3/013; G06K 9/00597; G06K 9/00899; G09G 2320/0626; G09G 2320/0646; G09G 2340/14; G09G 2354/00; G09G 2360/144; G09G 2360/145; G09G 2360/16; G09G 5/10; H04N 21/4223; H04N 21/4854; H04N 5/57; H04N 5/58

See application file for complete search history.

(56) References Cited

U.S. PATENT DOCUMENTS

| | | | | |
|---|---|---|---|---|
| 6,411,306 | B1 | 6/2002 | Miller | |
| 8,675,029 | B2 | 3/2014 | Benjamin | |
| 2003/0122845 | A1 | 7/2003 | Lee | |
| 2010/0060671 | A1* | 3/2010 | Park | G09G 3/3413 345/690 |
| 2010/0080459 | A1* | 4/2010 | Dai | G06T 5/009 382/170 |
| 2015/0009249 | A1* | 1/2015 | Kudo | G09G 3/36 345/691 |
| 2017/0047046 | A1 | 2/2017 | Tam | |

FOREIGN PATENT DOCUMENTS

| | | | |
|---|---|---|---|
| WO | 03090168 | A1 | 10/2003 |
| WO | 2016038358 | A1 | 3/2016 |

* cited by examiner

*Primary Examiner* — Insa Sadio

(74) *Attorney, Agent, or Firm* — Benjamin Balser; Next ip Law Group

(57) ABSTRACT

A system and a method for adjusting luminance flashes in a video stream are disclosed. The method includes identifying a sequence of frames, having the luminance flashes, from the video stream. The sequence of frames is extended at both sides (start and end) based on a predefined threshold. The method further comprises dividing an extended sequence of frames into at least three segments. Further, the method includes determining a correction factor and a correction constant for each of the at least three segments. Thereafter, the method includes modifying luminance values of pixels of each of the at least three segments based on the correction factor and the correction constant, thereby adjusting the luminance flashes in the video stream.

22 Claims, 4 Drawing Sheets

SYSTEM AND METHOD FOR CORRECTING PHOTOSENSITIVE EPILEPSY LUMINANCE FLASHES IN A VIDEO

FIELD OF THE DISCLOSURE

The present disclosure is generally related to video processing, and more particularly related to a method of adjusting luminance flashes in a video stream.

BACKGROUND

The subject matter disclosed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also correspond to implementations of the claimed technology.

Photosensitive Epilepsy (PSE) is a form of epilepsy where seizures are triggered by visual stimuli, such as flashing lights and high contrasting geometric patterns. Typically, human eyes are more sensitive to a bright area, therefore people suffer from the photosensitive epilepsy when individual views video frames contain repeatedly flashing light. For example, a televised program including a dance club scene with strobe lighting or a scene with many camera flashes may cause adverse reactions for certain viewers. As a result, certain viewers may not be able to watch the program. Further, during the program, a harmful flash occurs when a pair of opposing changes may occur in luminance (i.e., an increase in luminance followed by a decrease, or a decrease in the luminance followed by an increase) of 20 $cd/m^2$ or more. It should be noted such pair of opposing changes may occur when a screen luminance of a darker region is below 160 cd/m2.

Currently, a sequence of flashes may not be permitted when a combined area of flashes occurring concurrently and occupies more than 25% of the displayed screen area. Further, the sequence of the flashes may not be permitted when a flash frequency is higher than 3 Hz. Therefore, there may be a need for an improved system and method for reducing the Photosensitive Epilepsy (PSE) triggers.

SUMMARY

In one aspect of the present disclosure, a method for adjusting luminance flashes in a video stream is provided. The method includes identifying at least one sequence of frames, having the luminance flashes, from the video stream. The method further includes extending each of the at least one sequence of frames at ends based on a predefined threshold. The extended sequence of frames is divided into at least three segments. Further, the method includes determining a correction factor and a correction constant for each of the at least three segments. Thereafter, the method includes modifying luminance values of pixels of each of the at least three segments based on the correction factor and the correction constant, thereby adjusting the luminance flashes in the video stream.

In another aspect of the present disclosure, a method for adjusting luminance flashes in a video stream is provided. The method includes identifying at least one sequence of frames, having the luminance flashes, from the video stream.

A start point of the at least one sequence of frames is identified as S and an end point of the at least one sequence of frames is identified as E. The method further includes extending each of the at least one sequence of frames at ends based on a predefined threshold. The extended sequence of frames is identified as S'-S-E-E'. Further, the extended sequence of frames are divided into at least three segments, represented as S'-S-E-E', where S'-S represents a first segment, S-E represents a second segment, and E-E' represents a third segment. Further, the method includes determining a correction factor and a correction constant for each of the at least three segments. Thereafter, the method includes modifying luminance values of pixels of the first segment and the third segment based on a linear expression y=mx+c, where 'y' denotes the modified luminance value of the pixel, 'x' denotes the original luminance value of the pixel, 'm' denotes the correction factor for changing the original luminance value of the pixel, and 'c' denotes the correction constant which is a minimum luminance value used while the original luminance value of the pixel is zero. Further, the method includes modifying luminance values of pixels of the second segment based on the linear expression y=mx+c, where values of 'm' and 'c' are predefined, thereby adjusting the luminance flashes in the video stream.

In another aspect of the present disclosure, a system for adjusting luminance flashes in a video stream is provided. The system includes a processor and a memory. The processor is configured to execute programmed instructions stored in the memory to identify at least one sequence of frames, having the luminance flashes, from the video stream. The processor is further configured to extend each of the at least one sequence of frames at ends based on a predefined threshold. Further, the processor is configured to divide an extended sequence of frames into at least three segments. The processor is further configured to determine a correction factor and a correction constant for each of the at least three segments. Thereafter, the processor is configured to modify luminance values of pixels of each of the at least three segments based on the correction factor and the correction constant, thereby adjusting the luminance flashes in the video stream.

In another aspect of the present disclosure, a system for adjusting luminance flashes in a video stream is provided. The system includes a processor and a memory. The processor is configured to execute programmed instructions stored in the memory to identify at least one sequence of frames, having the luminance flashes, from the video stream. A start point of the at least one sequence of frames is identified as S and an end point of the at least one sequence of frames is identified as E. Further, the processor is configured to extend each of the at least one sequence of frames at ends based on a predefined threshold. An extended sequence of frames is identified as S'-S-E-E'. The extended sequence of frames is divided into at least three segments, represented as S'-S-E-E', where S'-S represents a first segment, S-E represents a second segment, and E-E' represents a third segment. The processor is further configured to determine a correction factor and a correction constant for each of the at least three segments. Thereafter, the processor is configured to modify luminance values of pixels of the first segment and the third segment based on a linear expression y=mx+c, where 'y' denotes the modified luminance value of the pixel, 'x' denotes the original luminance value of the pixel, 'm' denotes the correction factor for changing the original luminance value of the pixel, and 'c' denotes the correction constant which is a minimum luminance value used while the original luminance value of the pixel is zero. Further, the processor is configured to modify luminance values of pixels of the second segment based on the linear expression y=mx+c, where values of 'm' and 'c' are predefined, thereby adjusting the luminance flashes in the video stream.

In one aspect of the present disclosure, a non-transient computer-readable medium comprising instructions for causing a programmable processor to adjust luminance flashes in a video stream by identifying at least one sequence of frames, having the luminance flashes, from the video stream. Each of the at least one sequence of frames is extended at ends based on a predefined threshold. An extended sequence of frames is divided into at least three segments. Further, a correction factor and a correction constant for each of the at least three segments are determined. Thereafter, luminance values of pixels of each of the at least three segments are modified based on the correction factor and the correction constant, thereby adjusting the luminance flashes in the video stream.

In another aspect of the present disclosure, a non-transient computer-readable medium comprising instructions for causing a programmable processor to adjust luminance flashes in a video stream by identifying at least one sequence of frames, having the luminance flashes, from the video stream. A start point of the at least one sequence of frames is identified as S and an end point of the at least one sequence of frames is identified as E. Each of the at least one sequence of frames is identified at ends based on a predefined threshold. An extended sequence of frames is identified as S'-S-E-E'. Further, the extended sequence of frames is divided into at least three segments, represented as S'-S-E-E', where S'-S represents a first segment, S-E represents a second segment, and E-E' represents a third segment. Further, a correction factor and a correction constant for each of the at least three segments are determined. Thereafter, luminance values of pixels of the first segment and the third segment are modified based on a linear expression y=mx+c, where 'y' denotes the modified luminance value of the pixel, 'x' denotes the original luminance value of the pixel, 'm' denotes the correction factor for changing the original luminance value of the pixel is changed, and 'c' denotes the correction constant which is a minimum luminance value used while the original luminance value of the pixel is zero. Further, luminance values of pixels of the second segment are modified based on the linear expression y=mx+c, where values of 'm' and 'c' are predefined, thereby adjusting the luminance flashes in the video stream.

Other features and aspects of this disclosure will be apparent from the following description and the accompanying drawings.

BRIEF DESCRIPTION OF THE DRAWINGS

The accompanying drawings illustrate various embodiments of systems, methods, and embodiments of various other aspects of the disclosure. Any person with ordinary skills in the art will appreciate that the illustrated element boundaries (e.g. boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles.

DETAILED DESCRIPTION

Some embodiments of this disclosure, illustrating all its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context clearly dictates otherwise. Although any systems and methods similar or equivalent to those described herein can be used in the practice or testing of embodiments of the present disclosure, the preferred, systems and methods are now described.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

Figure 1:
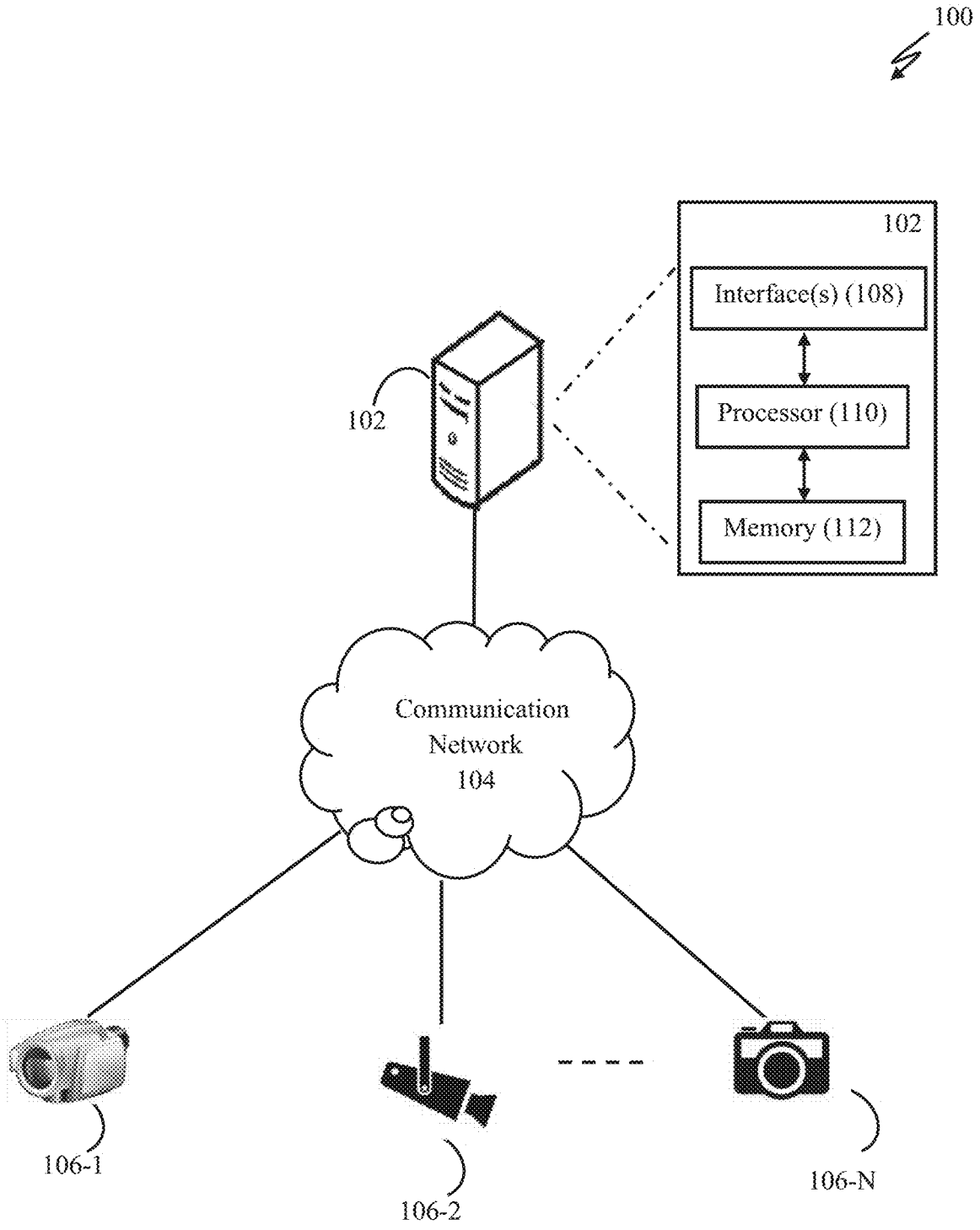
FIG. 1 illustrates a network connection diagram 100 of a system 102 for adjusting luminance flashes in a video stream, according to embodiments of the present disclosure.

It is an object of the current disclosure to provide a system and a method for adjusting luminance flashes in a video stream. FIG. 1 illustrates a network connection diagram 100 of a system 102 for adjusting the luminance flashes in the video stream, in accordance with an embodiment of present disclosure. The network connection diagram 100 further illustrates a communication network 104 connected to the system 102 and video capturing devices 106-1 to 106-N.

The communication network 104 may be implemented using at least one communication technique selected from Visible Light Communication (VLC), Worldwide Interoperability for Microwave Access (WiMAX), Long term evolution (LTE), Wireless local area network (WLAN), Infrared (IR) communication, Public Switched Telephone Network (PSTN), Radio waves, and any other wired and/or wireless communication technique known in the art.

The video capturing devices 106-1 to 106-N may include digital video capturing devices, such as a handy cam 106-1, a Closed Circuit Television (CCTV) camera 106-2, a digital camera 106-N, or any other suitable video capturing means for capturing digital videos. In an embodiment, a digital video stream, captured using the video capturing devices 106-1 to 106-N, may comprise of a series of video frames. It should be noted that the series of video frames may comprise luminance flashes.

The system 102 may further comprise interface(s) 108, processor 110, and a memory 112. The interface(s) 108 may be used to interact with or program the system 102 to adjust luminance flashes in a video stream. The interface(s) 108 may either be a Command Line Interface (CLI) or a Graphical User Interface (GUI).

The processor 110 may execute computer program instructions stored in the memory 112. The processor 110 may also be configured to decode and execute any instructions received from one or more other electronic devices or one or more remote servers. In an embodiment, the processor 110 may also be configured to process video streams received from the video capturing devices 106-1 to 106-N. The processor 110 may include one or more general purpose processors (e.g., INTEL microprocessors) and/or one or more special purpose processors (e.g., digital signal processors or Xilinx System On Chip (SOC) Field Programmable Gate Array (FPGA) processor). The processor 110 may be configured to execute one or more computer-readable program instructions, such as program instructions to carry out any of the functions described in this description.

The memory 112 may include a computer readable medium. A computer readable medium may include volatile and/or non-volatile storage components, such as optical, magnetic, organic or other memory or disc storage, which may be integrated in whole or in part with a processor, such as the processor 110. Alternatively, the entire computer readable medium may be present remotely from the processor 110 and coupled to the processor 110 by connection mechanism and/or network cable. In addition to the memory 112, there may be additional memories that may be coupled with the processor 110.

In one embodiment, at least one device of the video capturing devices 106-1 to 106-N may be used to capture a digital video stream. The digital video stream may be composed of a series of video frames. The digital video stream may be transmitted to the system 106, through the communication network 104, for further processing to adjust the luminance flashes in the video stream.

At first, a sequence of video frames having the luminance flashes may be identified from a video stream. The video frames may henceforth be referred as frames. The sequence of frames may be identified as 'S-E', where 'S' represents a start point and 'E' represents an end point, of the at least one sequence of frames. It should be noted that the sequence of frames, comprising the luminance flashes, may be identified using a Photosensitive Epilepsy (PSE) flash detection technique. It will be apparent to one skilled in the art that the above-mentioned technique has been provided only for illustration purposes, without departing from the scope of the disclosure.

Successively, the sequence of frames may be extended. The sequence of frames may be extended on both sides (i.e. start and end) based on a predefined threshold. The extended sequence of frames may be identified as S'-S-E-E', where S' may represent a start point of the extended sequence of frames and E' may represent an end point of the extended sequence of frames. Successively, the extended sequence of frames may be divided into multiple segments. In one case, the extended sequence of frames may be divided into three segments; however the frame could be divided into more segments. The three segments may be represented as S'-S-E-E', where S'-S may represent a first segment, S-E may represent a second segment, and E-E' may represent a third segment.

Thereafter, a correction factor and a correction constant for each of the three segments may be determined. In one case, the correction factor and the correction constant may be determined based on a linear relation between an original luminance value of a pixel and a modified luminance value of the pixel. The linear relation may be defined using a below mentioned equation 1.

$$y=mx+c \quad \text{(Eq. 1)}$$

In Equation 1, y denotes a modified luminance value of the pixel and m denotes a correction factor based on which the original luminance value of the pixel is being modified. Further, x denotes the original luminance value of the pixel and c denotes a correction constant which is a minimum luminance value used when the original luminance value of the pixel is zero.

It should be noted that the correction factor and the correction constant for each of the at least three segments, may be a function of relative frame index (r), as represented using a below mentioned equation 2.

$$y=m(r)x+c(r) \quad \text{(Eq. 2)}$$

In Equation 2, m denotes a correction factor which is a function of the relative frame index (r) and c denotes a correction constant which is a function of the relative frame index (r). It should be noted that the relative frame index (r) may be measured relative to S or E.

The correction factor and the correction constant for the first segment, S'-S, may vary in a respective defined range between minimum and maximum values. The variation in function values i.e. the correction factor and the correction constant, may depend on the distance of the extended frame with respect to S or E. Thus, same kind of variation behaviour may be followed by the correction constant while the minimum values and the maximum values are different for the correction constant. It should be noted that farther the frame 'x' from S or E, the correction factor i.e., a multiplication factor may be higher and the correction constant may be lower. Further, luminance values of pixels of the first segment may be modified based on values of the correction factor and the correction constant. It should be noted that farther the frame is from end S' towards S, less luminance values of the pixels may be modified during the first segment.

It will be apparent to one skilled in the art that the above-mentioned technique for determining the correction factor and the correction constant for the first segment S'-S, based on a linear function, has been provided only for illustration purposes. In another embodiment, the correction factor may be determined based on other kinds of continuous functions or functions following different kinds of mathematical properties.

The correction factor and the correction constant for the second segment (S-E) may be predefined or fixed such that luminance values of the pixels are increased or decreased. It will be apparent to one skilled in the art that the above-mentioned technique for determining the correction factor and the correction constant for the second segment (S-E), based on a linear function, has been provided only for illustration purposes. In another embodiment, the correction factor and the correction constant may be determined based on a continuous function, where smaller pixel values tend to increase and higher pixel values tend to decrease (as shown by a line 204 in FIG. 2*b*).

It will be apparent to one skilled in the art that the above-mentioned technique for determining the correction factor and the correction constant for the third segment (E-E'), based on a linear function has been provided only for illustration purposes. In another embodiment, the correction factor may be determined based on other kinds of continuous functions or functions following different kinds of mathematical properties. In another embodiment, the correction factor may be determined based on a continuous function where the continuous function may be continuously decreasing as the correction factor reaches E'. Similarly, the correction constant may be continuously decreasing. It should be noted that the correction factor and the correction constant may use minimum and maximum values set by a user.

Figure 2A:
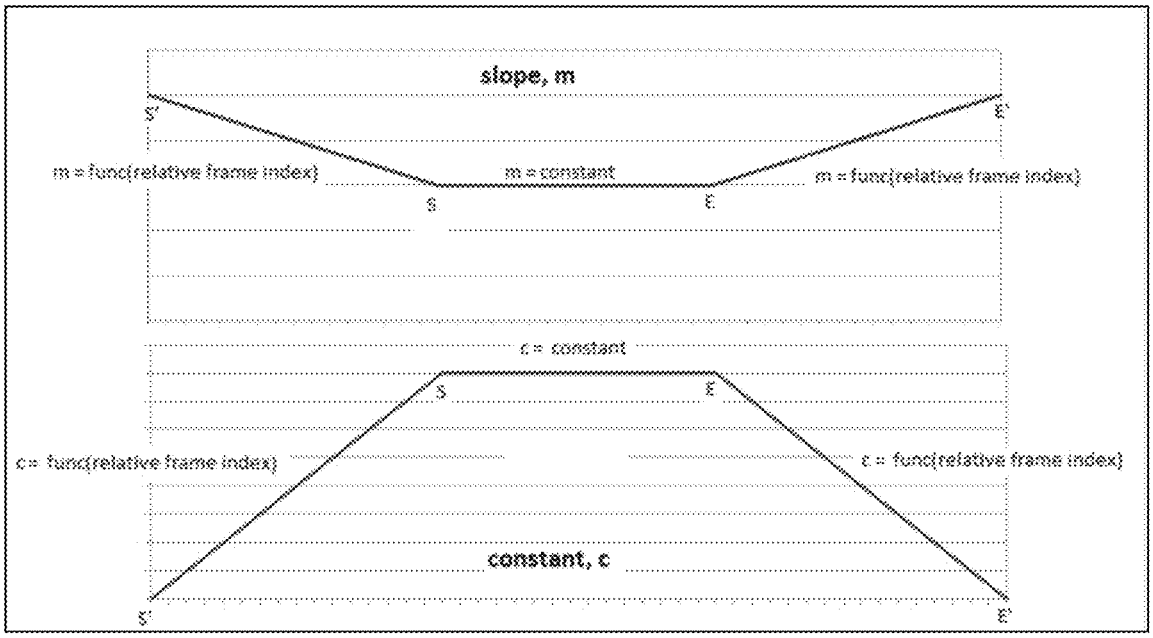
FIG. 2*a* illustrates a graph showing values of correction factor and correction constant for three segments of an extended sequence of frames, according to embodiments of the present disclosure.

For example, as shown in FIG. 2*a*, values of the correction factor and the correction constant for each of the at least three segments may be determined. Successively, luminance values of pixels of each of the three segments may be modified. The luminance values of the pixels of each of the three segments may be modified based on the correction factor and the correction constant. For instance, luminance values of the pixels of the first segment may be modified based on the variation in values of the correction factor and the correction constant from defined minimum and maximum values.

Figure 2B:
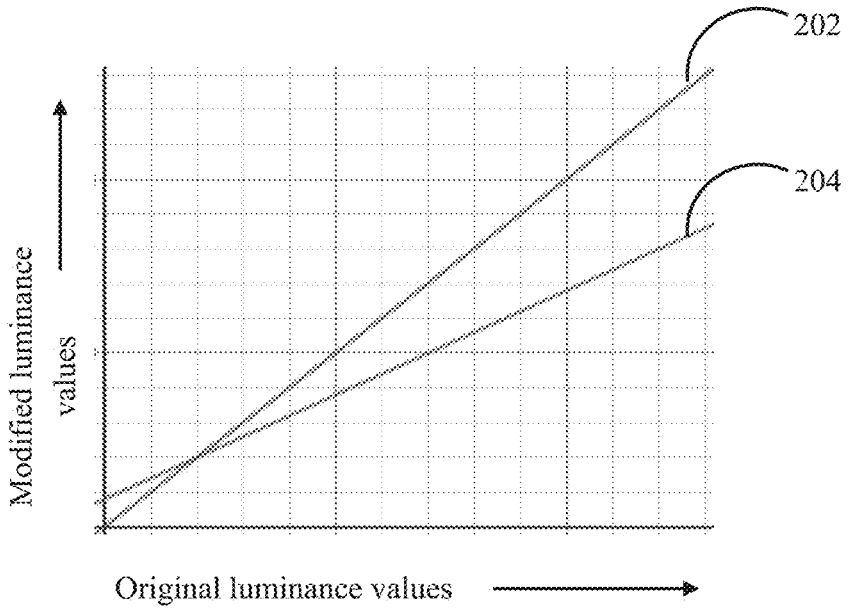
FIG. 2*b* illustrates a graph showing modified pixel values of a second segment of the extended sequence of frames, according to embodiments of the present disclosure.

Further, luminance values of the pixels of the second segment may be modified based on the fixed or predefined values of the correction factor and the correction constant. Further, as shown in FIG. 2*b*, the graph may depict a relation between original/old luminance values (shown on x-axis) and the modified/new luminance values (shown on y-axis) of the pixels during the second segment, S-E. Further, a line 202 shows the output when no change in the old luminance values is identified i.e. when y=x. Similarly, the line 204 shows the modified luminance values that may be determined based on the predefined values of the correction factor and the correction constant.

Figure 3A:
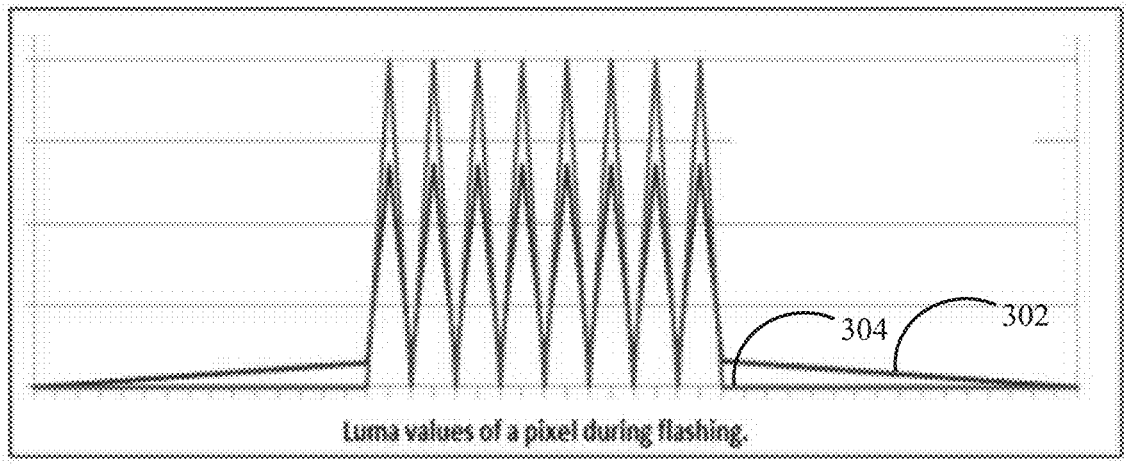
FIG. 3*a* illustrates an exemplary graph showing modified luminance values of a pixel during flashing, according to embodiments of the present disclosure.
Figure 3B:
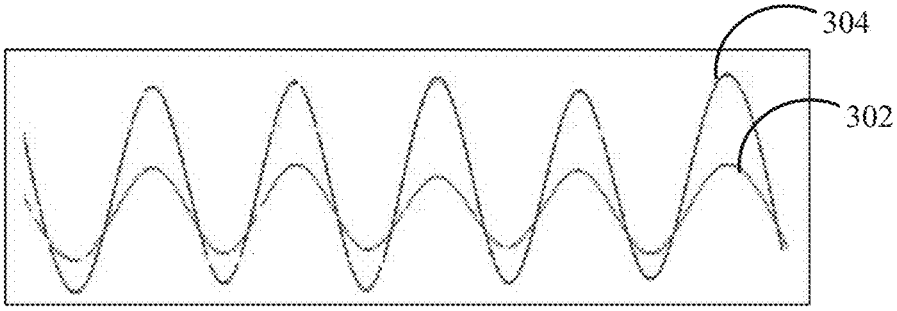
FIG. 3*b* illustrates an exemplary graph showing transition of a particular pixel during a flashy sequence in the video stream, according to embodiments of the present disclosure.

Further, luminance values of the pixels of the third segment may be modified, similar to the first segment (S'-S), based on values of the correction factor and the correction constant. It should be noted that farther the frame from end E towards E', less luminance values of the pixels may be modified during the third segment. Thus, the modification of the luminance values of the pixels of each of the three segments may result in adjusting the luminance flashes in the video stream. For example, as shown in FIG. 3*a*, a line 302 may represent a modified luminance value of the pixels and a line 304 may represent an original luminance value of the pixels. Thus, such method of adjusting the luminance value in the video stream may result in reduced Photosensitive Epilepsy (PSE) triggers.

In an exemplary embodiment, a flashiness sequence may need to be adjusted from 100th frame to 150th frame of a video stream. At first, S' may be set as 85, S may be set as 100, E may be set as 150, and E' may be set as 165. For the first segment, S'-S, (i.e., 85-100 frames), consider, a frame 'x' lies between S' and S. The correction factor and the correction constant in terms of a function of relative frame index (with respect to S) may be defined using below mentioned equations 3 and 4.

$$m(r)=C1*(S-x)+C2 \quad \text{(Eq. 3)}$$

$$c(r)=16-C3*(S-x) \quad \text{(Eq. 4)}$$

It should be noted that C1, C2, and C3 may depend on how luminance values of the pixel may be modified from S' to S or E to E'. Further, the equation 3 and equation 4 may be non-linear functions of intended pixel variation from S to S' and E to E'. Therefore, m(r) and c(r) may be any function of relative frame index and may depend on how application is modifying the luminance values of the pixel from one temporal location to other. Further, the luminance values of the pixels may be modified temporally instead of spatially. Further, the numeral '16' in equation 4 is a number by which a start point 'S' may be extended backwards. It will be apparent to one skilled in the art that the above-mentioned method may be applicable to any kind of function being used for m(r) and c(r). Further, spatial modification behaviour may be used in a similar way in order to modify the luminance values of the pixels, without departing from the scope of the disclosure.

Further, the function m(r): R→R may be continuous and may be increasing or decreasing with respect to 'r'. Further, the function c(r): R→R may be continuous and may be increasing or decreasing with respect to 'r'. It should be noted that the function definition or the function parameters may be computed based on how the luminance values of the pixel may be varied to tone down a level of flashiness. Using the linear expression, m(r) and c(r) may be determined in such a way that m(r) may tend to decrease when m(r) approaches to 'S' in which the m(r) may change old luminance values of the pixel significantly. On the other hand, c(r) may tend to increase in such a way that significant amount of increase or decrease may be associated with the old luminance values of the pixel present in frame(s) closer to the flashing sequence.

During the second segment (S-E), any function for m(r) and c(r) may be used to alter luminance values of the pixel based on original known signal values. It should be noted that the function may be linear or continuous in nature, such as smaller pixel values tend to increase and higher pixel values tend to decrease (as shown by the line 204 of FIG. 2*b*). Further, during the second segment, values of m(r) and c(r) may be fixed and the fixed values may be applied to all pixels of every frame in the second segment. It should be noted that any function of pixel values may be used as the values of m(r) and c(r).

During the third segment (E-E') (frame 151-frame 165), any function for m(r) and c(r), may be used to alter luminance values of the pixel based on original known signal values. It should be noted that the function may be linear, continuous in nature, and continuously decreasing, as the function reaches E'. In one case, a threshold could be set on minimum and maximum values of the function m(r). In an example, the function c(r) may be continuously decreasing. Further, in one case, a threshold could be set on minimum and maximum values of the function c(r).

Using the expression, a function of relative index (with respect to S) may be created for determining m(r) and c(r). Consider, a frame 'x' lies between frame 151 and frame 165, and equations for determining the correction factor and the correction constant in terms of a function of relative frame index (with respect to S) are:

$$m(r)=C1*(x-E)+C2 \quad \text{(Eq. 5)}$$

$$c(r)=16-C3*(x-E) \quad \text{(Eq. 6)}$$

It should be noted that values of m(r) and c(r) may be computed in such a way that m(r) may tend to increase up to a max of 1 when approaching to E'. Also, m(r) may not change the old luminance values of the pixel. Further, c(r)

may tend to decrease such that less significant amount of increase or decrease may be given to the old luminance values of the pixel which is in a frame closer to the end E'. Thus, based on the determined values of the m(r) and c(r), luminance values of the pixel in the video stream may be modified in order to reduce the Photosensitive Epilepsy (PSE) triggers.

Figure 4:
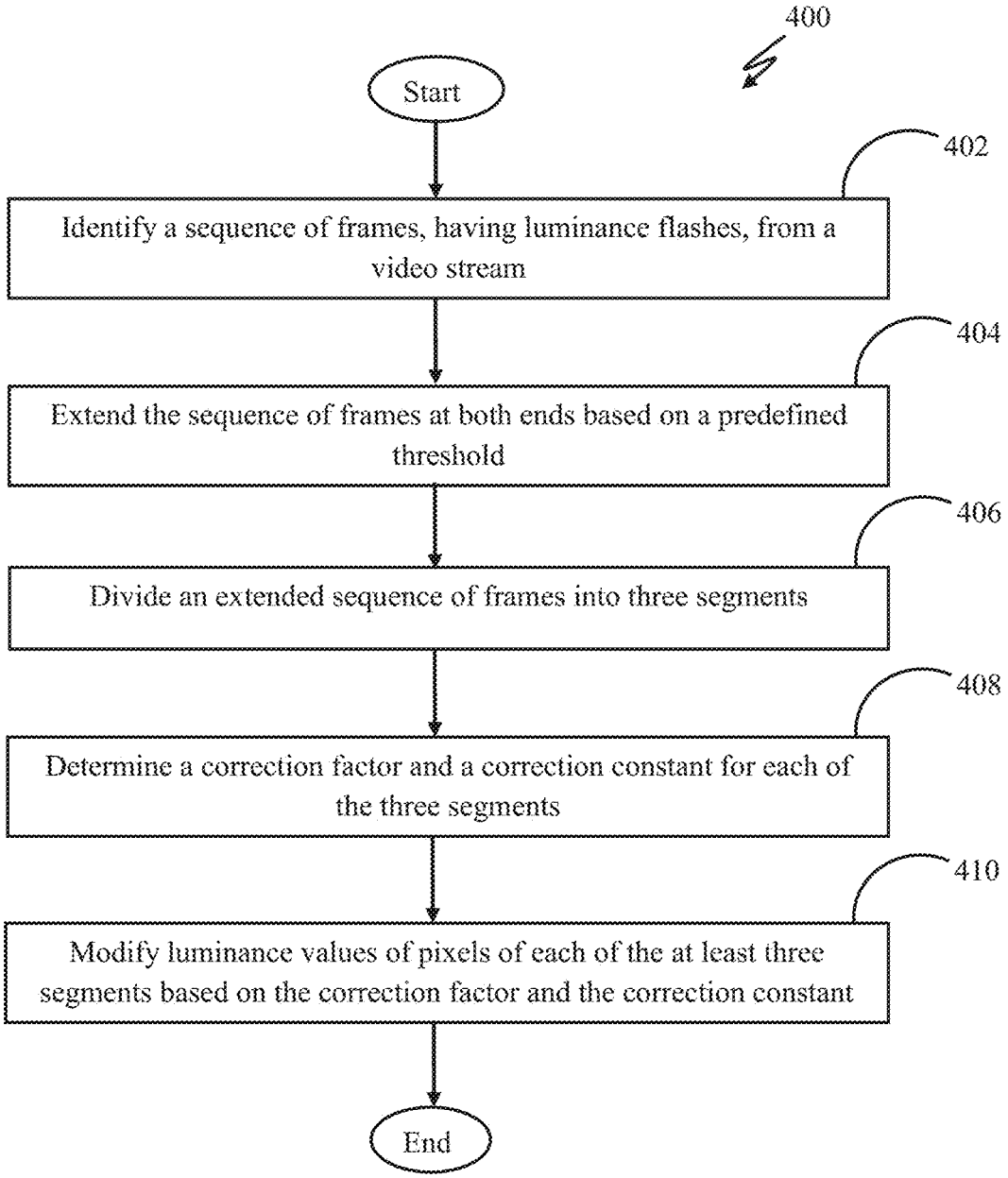
FIG. 4 illustrates a flowchart 400 showing a method for adjusting luminance flashes in a video stream, according to embodiments of the present disclosure.

FIG. 4 illustrates a flowchart of a method of adjusting luminance flashes in a video stream, according to an embodiment. The flow chart of FIG. 4 shows the method steps executed according to one or more embodiments of the present disclosure. In this regard, each block may represent a module, segment, or portion of code, which comprises one or more executable instructions for implementing the specified logical function(s). It should also be noted that in some alternative implementations, the functions noted in the blocks may occur out of the order noted in the drawings. For example, two blocks shown in succession in FIG. 4 may in fact be executed substantially concurrently or the blocks may sometimes be executed in the reverse order, depending upon the functionality involved. Any process descriptions or blocks in flow charts should be understood as representing modules, segments, or portions of code which include one or more executable instructions for implementing specific logical functions or steps in the process, and alternate implementations are included within the scope of the example embodiments in which functions may be executed out of order from that shown or discussed, including substantially concurrently or in reverse order, depending on the functionality involved. In addition, the process descriptions or blocks in flow charts should be understood as representing decisions made by a hardware structure such as a state machine. The flowchart 400 starts at the step 402 and proceeds to step 410.

At step 402, a sequence of frames having luminance flashes may be identified. Such sequence of frames may be identified from a video stream. In one embodiment, the sequence of frames may be checked by the processor 110.

At step 404, the sequence of frames may be extended. The sequence of frames may be extended at ends i.e. (start and end). The sequence of frames may be extended based on a predefined threshold. In one embodiment, the sequence of frames may be extended by the processor 110.

At step 406, the extended sequence of frames may be divided into three segments. In one embodiment, the extended sequence of frames may be divided by the processor 110.

At step 408, a correction factor and a correction constant may be determined for each of the three segments. In one embodiment, the correction factor and the correction constant may be determined by the processor 110.

At step 410, luminance values of pixels of the three segments may be modified. The luminance values may be modified based on the correction factor and the correction constant. In one embodiment, the luminance values of pixels of the three segments may be modified by the processor 110.

The logic of the example embodiment(s) can be implemented in hardware, software, firmware, or a combination thereof. In example embodiments, the logic is implemented in software or firmware that is stored in a memory and that is executed by a suitable instruction execution system. If implemented in hardware, as in an alternative embodiment, the logic can be implemented with any or a combination of the following technologies, which are all well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc. In addition, the scope of the present disclosure includes embodying the functionality of the example embodiments disclosed herein in logic embodied in hardware or software-configured mediums.

Embodiments of the present disclosure may be provided as a computer program product, which may include a computer-readable medium tangibly embodying thereon instructions, which may be used to program a computer (or other electronic devices) to perform a process. The computer-readable medium may include, but is not limited to, fixed (hard) drives, magnetic tape, floppy diskettes, optical disks, compact disc read-only memories (CD-ROMs), and magneto-optical disks, semiconductor memories, such as ROMs, random access memories (RAMs), programmable read-only memories (PROMs), erasable PROMs (EPROMs), electrically erasable PROMs (EEPROMs), flash memory, magnetic or optical cards, or other type of media/machine-readable medium suitable for storing electronic instructions (e.g., computer programming code, such as software or firmware). Moreover, embodiments of the present disclosure may also be downloaded as one or more computer program products, wherein the program may be transferred from a remote computer to a requesting computer by way of data signals embodied in a carrier wave or other propagation medium via a communication link (e.g., a modem or network connection).

It will be appreciated that variants of the above disclosed, and other features and functions or alternatives thereof, may be combined into many other different systems or applications. Presently unforeseen or unanticipated alternatives, modifications, variations, or improvements therein may be subsequently made by those skilled in the art that are also intended to be encompassed by the following claims.

What is claimed is:

1. A method of adjusting luminance flashes in a video stream, the method comprising:

identifying at least one sequence of frames, having the luminance flashes, from the video stream;

extending each of the at least one sequence of frames at ends based on a predefined threshold;

dividing an extended sequence of frames into at least three segments;

determining a correction factor and a correction constant for each of the at least three segments; and modifying luminance values of pixels of each of the at least three segments based on the correction factor and the correction constant, thereby adjusting the luminance flashes in the video stream.

2. The method of claim 1, wherein the luminance flashes are adjusted to reduce Photosensitive Epilepsy (PSE) triggers.

3. The method of claim 1, wherein the at least one sequence of frames, having the luminance flashes, is identified using a Photosensitive Epilepsy (PSE) flash detection technique.

4. The method of claim 1, wherein the correction factor and the correction constant are determined based on a linear relation between original luminance value of a pixel and a modified luminance value of the pixel, defined as $y=mx+c$, wherein 'y' denotes the modified luminance value of the pixel, 'x' denotes the original luminance value of the pixel, 'm' denotes the correction factor for changing the original luminance value of the pixel, and 'c' denotes the correction constant which is a minimum luminance value used while luminance value of the pixel is zero.

5. The method of claim 4, wherein the correction factor (m) and the correction constant (c) are functions of relative frame index (r), for extended sequences.

6. The method of claim 1, wherein the luminance values of pixels of each of the at least three segments are modified based on a mathematical function defining a mathematical relation between 'x' and 'y,' wherein 'x' denotes an original luminance value of the pixel and 'y' denotes modified luminance value of the pixel.

7. A method for adjusting luminance flashes in a video stream, the method comprising:

identifying at least one sequence of frames, having the luminance flashes, from the video stream, wherein a start point of the at least one sequence of frames is identified as S and an end point of the at least one sequence of frames is identified as E;

extending each of the at least one sequence of frames at ends based on a predefined threshold, wherein an extended sequence of frames is identified as S'-S-E-E';

dividing the extended sequence of frames into at least three segments, represented as S'-S-E-E', wherein S'-S represents a first segment, S-E represents a second segment, and E-E' represents a third segment;

determining a correction factor and a correction constant for each of the at least three segments;

modifying luminance values of pixels of the first segment and the third segment based on a linear expression y=mx+c, wherein 'y' denotes the modified luminance value of the pixel, 'x' denotes the original luminance value of the pixel, 'm' denotes the correction factor for changing the original luminance value of the pixel, and 'c' denotes the correction constant which is a minimum luminance value used while the original luminance value of the pixel is zero, and modifying luminance values of pixels of the second segment based on the linear expression y=mx+c, wherein values of 'm' and 'c' are predefined, thereby adjusting the luminance flashes in the video stream.

8. The method of claim 7, wherein the correction factor (m) and the correction constant (c) are functions of relative frame index (r), for extended sequences.

9. The method of claim 7, wherein the luminance flashes are adjusted to reduce Photosensitive Epilepsy (PSE) triggers.

10. The method of claim 7, wherein the at least one sequence of frames, having the luminance flashes, is identified using a Photosensitive Epilepsy (PSE) flash detection technique.

11. A system for adjusting luminance flashes in a video stream, the system comprising:

a processor; and a memory, wherein the processor is configured to execute programmed instructions stored in the memory to:

identify at least one sequence of frames, having the luminance flashes, from the video stream;

extend each of the at least one sequence of frames at ends based on a predefined threshold;

divide an extended sequence of frames into at least three segments;

determine a correction factor and a correction constant for each of the at least three segments; and modify luminance values of pixels of each of the at least three segments based on the correction factor and the correction constant, thereby adjusting the luminance flashes in the video stream.

12. The system of claim 11, wherein the luminance flashes are adjusted to reduce Photosensitive Epilepsy (PSE) triggers.

13. The system of claim 11, wherein the at least one sequence of frames, having the luminance flashes, is identified using a Photosensitive Epilepsy (PSE) flash detection technique.

14. The system of claim 11, wherein the correction factor and the correction constant are determined based on a linear relation between original luminance value of a pixel and a modified luminance value of the pixel, defined as y=mx+c, wherein 'y' denotes the modified luminance value of the pixel, 'x' denotes the original luminance value of the pixel, 'm' denotes the correction factor for changing the original luminance value of the pixel, and 'c' denotes the correction constant which is a minimum luminance value used while luminance value of the pixel is zero.

15. The system of claim 14, wherein the correction factor (m) and the correction constant (c) are functions of relative frame index (r), for extended sequences.

16. The system of claim 11, wherein the luminance values of pixels of each of the at least three segments are modified based on a mathematical function defining a mathematical relation between 'x' and 'y,' wherein 'x' denotes an original luminance value of the pixel and 'y' denotes modified luminance value of the pixel.

17. A system for adjusting luminance flashes in a video stream, the system comprising:

a processor; and a memory, wherein the processor configured to execute programmed instructions stored in the memory to:

identify at least one sequence of frames, having the luminance flashes, from the video stream, wherein a start point of the at least one sequence of frames is identified as S and an end point of the at least one sequence of frames is identified as E;

extend each of the at least one sequence of frames at ends based on a predefined threshold, wherein an extended sequence of frames is identified as S'-S-E-E';

divide the extended sequence of frames into at least three segments, represented as S'-S-E-E', wherein S'-S represents a first segment, S-E represents a second segment, and E-E' represents a third segment;

determine a correction factor and a correction constant for each of the at least three segments;

modify luminance values of pixels of the first segment and the third segment based on a linear expression y=mx+c, wherein 'y' denotes the modified luminance value of the pixel, 'x' denotes the original luminance value of the pixel, 'm' denotes the correction factor for changing the original luminance value of the pixel, and 'c' denotes the correction constant which is a minimum luminance value used while the original luminance value of the pixel is zero, and modify luminance values of pixels of the second segment based on the linear expression y=mx+c, wherein values of 'm' and 'c' are predefined, thereby adjusting the luminance flashes in the video stream.

18. The system of claim 17, wherein the correction factor (m) and the correction constant (c) are functions of relative frame index (r), for extended sequences.

19. The system of claim 17, wherein the luminance flashes are adjusted to reduce Photosensitive Epilepsy (PSE) triggers.

20. The system of claim 17, wherein the at least one sequence of frames, having the luminance flashes, is identified using a Photosensitive Epilepsy (PSE) flash detection technique.

21. A non-transient computer-readable medium comprising instructions for causing a programmable processor to adjust luminance flashes in a video stream by:

identifying at least one sequence of frames, having the luminance flashes, from the video stream;

extending each of the at least one sequence of frames at ends based on a predefined threshold;

dividing an extended sequence of frames into at least three segments;

determining a correction factor and a correction constant for each of the at least three segments; and modifying luminance values of pixels of each of the at least three segments based on the correction factor and the correction constant, thereby adjusting the luminance flashes in the video stream.

22. A non-transient computer-readable medium comprising instructions for causing a programmable processor to adjust luminance flashes in a video stream by:

identifying at least one sequence of frames, having the luminance flashes, from the video stream, wherein a start point of the at least one sequence of frames is identified as S and an end point of the at least one sequence of frames is identified as E;

extending each of the at least one sequence of frames at ends based on a predefined threshold, wherein an extended sequence of frames is identified as S'-S-E-E;

dividing the extended sequence of frames into at least three segments, represented as S'-S-E-E', wherein S'-S represents a first segment, S-E represents a second segment, and E-E' represents a third segment;

determining a correction factor and a correction constant for each of the at least three segments;

modifying luminance values of pixels of the first segment and the third segment based on a linear expression y=mx+c, wherein 'y' denotes the modified luminance value of the pixel, 'x' denotes the original luminance value of the pixel, 'm' denotes the correction factor for changing the original luminance value of the pixel, and 'c' denotes the correction constant which is a minimum luminance value used while the original luminance value of the pixel is zero, and modifying luminance values of pixels of the second segment based on the linear expression y=mx+c, wherein values of 'm' and 'c' are predefined, thereby adjusting the luminance flashes in the video stream.

* * * * *